US007090313B1

(12) United States Patent
McMurray

(10) Patent No.: US 7,090,313 B1
(45) Date of Patent: Aug. 15, 2006

(54) MUSICAL INSTRUMENT DISPLAY CASE

(76) Inventor: Jeffrey L McMurray, P.O. Box 1509, Rockport, TX (US) 78381

( * ) Notice: Subject to any disclaimer, the term of this patent is extended or adjusted under 35 U.S.C. 154(b) by 53 days.

(21) Appl. No.: 10/743,187

(22) Filed: Dec. 22, 2003

(51) Int. Cl.
*A47F 3/00* (2006.01)

(52) U.S. Cl. ..... 312/138.1; 312/114

(58) Field of Classification Search ..... 312/138.1, 312/109, 114, 257.1, 326, 329, 245; 206/14, 206/214

See application file for complete search history.

(56) References Cited

U.S. PATENT DOCUMENTS

| | | | | | |
|---|---|---|---|---|---|
| 561,613 | A | * | 6/1896 | Robin | 312/114 |
| 618,887 | A | * | 2/1899 | Levit | 312/114 |
| 694,987 | A | * | 3/1902 | Pollard | 312/100 |
| 1,961,137 | A | | 6/1934 | Haan | |
| 2,120,826 | A | | 3/1938 | Young | |
| 3,346,310 | A | | 10/1967 | Diack | |
| 3,993,378 | A | * | 11/1976 | Berkus | 312/293.3 |
| 4,209,212 | A | * | 6/1980 | McGoldrick | 312/245 |
| 4,320,829 | A | | 3/1982 | DiMarzio et al. | |
| 5,118,171 | A | | 6/1992 | Ortiz | |
| 5,377,829 | A | | 1/1995 | Bahl | |
| 5,546,714 | A | * | 8/1996 | Kenkel | 52/204.5 |
| 5,558,416 | A | | 9/1996 | Dumitru | |
| 5,947,208 | A | * | 9/1999 | Ha | 169/51 |
| 6,158,828 | A | | 12/2000 | Vacovsky et al. | |
| 6,322,174 | B1 | | 11/2001 | Palmqvist | |
| 6,398,322 | B1 | | 6/2002 | Chaplin | |
| 2001/0040423 | A1 | * | 11/2001 | Sheehan | 312/245 |

FOREIGN PATENT DOCUMENTS

| | | | |
|---|---|---|---|
| EP | 098195 | * | 1/1984 |
| FR | 2743928 | | 7/1997 |

OTHER PUBLICATIONS

Heritage Heirloom Series Cases, publication of guitar display cases, 7 pages, Nov. 2002.*

Katahdin Studio Furniture, "Handcrafted Cabinetry for your Favorit Instruments", 1 page, Aug. 2002.*

Katahdin Studio Furniture, "Guitar corner Cabinet" & "Presentation Guitar Cabinet", 2 pages, Aug. 2002.* http://www.katahdin-online.com, (no date given).

* cited by examiner

*Primary Examiner*—James O. Hansen
(74) *Attorney, Agent, or Firm*—Michael I. Kroll

(57) ABSTRACT

The present invention 10 discloses a display case 12 for musical instruments 26. The display case comprises a housing 12 having spaced apart top surface 14 and bottom surface 16 with side walls 26, back wall 18 and front wall 21 positioned therebetween. Both the interior and exterior of the cabinet 12 are covered with fabric material, along with the inside of the back panel. The front wall 21 is a removable structure 22 having a border with a transparent member 24 positioned therein for viewing the displayed musical instrument 26. The interior of the case has a fastener or fasteners 28 on the back wall for attaching the musical instrument 26 and a light 42 which can be located on the base for illuminating the displayed article. A door stop 38 is located on the interior side walls having hook and loop material 40 on the anterior side that mates with hook and loop material located on the interior side of the front panel 22 forming retaining means for the front panel. Also located on the front panel 22 is a handle 30, a brass knob in the preferred embodiment, for removing the front panel providing access to the display case interior. Additionally, the front corners of the case can have metallic edge protectors 32 and the exterior base can have polymeric or elastomeric pads.

4 Claims, 9 Drawing Sheets

MUSICAL INSTRUMENT DISPLAY CASE

BACKGROUND OF THE INVENTION

1. Field of the Invention

The present invention relates generally to display cases and, more specifically, to a display case for musical instruments, in the preferred embodiment a guitar or bass guitar. The display case is comprised of a housing having spaced apart top surface and bottom surface with side walls, back wall and front wall positioned therebetween. Both the interior and exterior of the cabinet are covered with fabric material, along with inside of back panel. The front wall is a removable structure having a border with a transparent member positioned therein for viewing the displayed musical instrument. The interior of the case has a fastener on the back wall for attaching the musical instrument and a light located on the base for illuminating the displayed article. There are also apertures within the back wall for mounting the display case to a wall. A number of stop blocks are located on the interior side walls having hook and loop material on the anterior side that mates with hook and loop material located on the interior side of the front panel forming retaining means for the front panel. The front panel is dimensionally designed to frictionally fit within the display case front panel aperture. The frame of the front panel can be covered with fabric and piping positioned on the periphery edge. Also located on the front panel is a handle, a brass knob in the preferred embodiment, for removing the front panel providing access to the display case interior. Additionally, the front corners of the case can have metallic edge protectors and the exterior base can have polymeric or elastomeric pads.

2. Description of the Prior Art

There are other display cases designed for article display. Typical of these is U.S. Pat. No. 694,987 issued to Pollard on Mar. 11, 1902.

Another patent was issued to De Haan on Jun. 5, 1934 as U.S. Pat. No. 1,961,137. Yet another U.S. Pat. No. 2,120,826 was issued to Young on Jun. 14, 1938 and still yet another was issued on Oct. 10, 1967 to Diack as U.S. Pat. No. 3,346,310.

Another patent was issued to DiMarzio on Mar. 23, 1982 as U.S. Pat. No. 4,320,829. Yet another U.S. Pat. No. 5,118,171 was issued to Ortiz on Jun. 2, 1992. Another was issued to Bahl on Jan. 3, 1995 as U.S. Pat. No. 5,377,829 and still yet another was issued on Sep. 24, 1996 to Dumitru as U.S. Pat. No. 5,558,416.

Another patent was issued to Vacovsky et al. on Dec. 12, 2000 as U.S. Pat. No. 6,158,828. Yet another U.S. Pat. No. 6,322,174 was issued to Palmqvist on Nov. 27, 2001. Another was issued to Chaplin on Jun. 4, 2002 as U.S. Pat. No. 6,398,322 and still yet another was issued on Jul. 25, 1997 to Janvier as French Patent No. FR2743928.

U.S. Pat. No. 694,987

Inventor: Frederick Pollard

Issued: Mar. 11, 1902

A show-case of the character set forth comprising a base, glass plates mounted upon said base, and forming the top and sides of said case, metallic straps connecting the adjacent edges of said plates, a false top of wood or other easily-penetrated substance arranged within said case and means rigidly secured to said straps and forming supports for said false top.

U.S. Pat. No. 1,961,137

Inventor: Rufus DeHaan

Issued: Jun. 5, 1934

In a celery show case, a double walled metal case having means to support it upright, a transparent close-fitting front door therefor, a limited doorway in the bottom having a close-fitting hinged door therefor, an inclined floor section spaced from the lower end of said case delivering downwardly to said limited doorway, a follower at one side of the said case, and elastic means connecting the said follower to the opposite side of the case to maintain the celery stalks in upright position and carry them to the delivery position.

U.S. Pat. No. 2,120,826

Inventor: Everett F. Young

Issued: Jun. 14, 1938

A display holder of the character described comprising a shallow tray for the reception of an article to be displayed, and a cover therefor of thin transparent material, curved substantially continuously transversely of its extent and having plane transparent end portions the edges of which are homogeneously united directly to the end edges of the central portion substantially throughout the extent of the end edges of the central portion to provide substantially complete transparency for the cover throughout its entire extent.

U.S. Pat. No. 3,346,310

Inventor: Arthur G. Diack

Issued: Oct. 10, 1967

A showcase-frame corner construction, including:

(a) a post member and two rail members respectively having square-cut ends positioned in corner-forming relation;

(b) said post member and said rail members respectively having longitudinal sockets therein which extend to said square-cut ends thereof;

(c) said post member and one of said rail members respectively having therein longitudinally-extending panel-receiving channels in a common plane;

(d) said post member and the other of said rail members respectively having therein longitudinally extending panel-receiving channels in a common plane;

(e) a corner connector having three prongs respectively aligned with and plunged into said sockets in said post and rail members and having three abutment surfaces respectively parallel to and engaged by said square-cut ends of said members in abutting relation;

(f) said prongs having snug sliding fits in said sockets; and (g) means comprising screws respectively extending laterally into said sockets and into engagement with said prongs, and bearing against said members, for securing said ends of said members to said prongs, respectively, whereby said snug fitting prongs and said screws constitute multiple securing means holding said post and rail members in assembled relation.

U.S. Pat. No. 4,320,829

Inventor: Lawrence DiMarzio, et al.

Issued: Mar. 23, 1982

A trapezohedral insert converts a parallelepiped transparent plastic container into an effective merchandise display. Merchandise is held in the insert, easily inserted into the container with a minimum of expense for support material and labor.

U.S. Pat. No. 5,118,171

Inventor: Sigifredo Ortiz

Issued: Jun. 2, 1992

A display case is disclosed which is particularly useful for mounting and attractively displaying an article of headgear along with memorabilia related to the headgear. The case has generally rectangular box-like frame divided into an upper portion and a lower portion by a shelf member extending transversely between the side walls. A background panel of rigid penetrable material is disposed adjacent the back wall and has fabric material secured thereon to serve as an ornamental background. The fabric material comprises a first section of decorative fabric material, such as a flag, disposed in the frame upper portion to serve as an ornamental background for an article of headgear, and a second section of fabric fastener material disposed in the frame lower portion serves as a mounting surface for awards, medals, and other memorabilia related to the headgear. The material in the lower portion has a soft pile formed of loops to releasably receive and retain the hook element of a hook-and-loop type fabric fastener for securing objects thereon by fabric fastener elements and the penetrable material substrate allows objects having pins, tacks, and other sharp objects to be releasably pinned to the background panel. An article of headgear is secured in the frame upper portion, and articles of memorabilia related to the headgear are secured on the fastener material in the lower portion of the case. A pane of transparent material covers the lower portion of the frame and the articles of memorabilia.

U.S. Pat. No. 5,377,829

Inventor: Ronald J. Bahl

Issued: Jan. 3, 1995

A football display case comprising a base in a rectangular configuration having an upper surface and a lower surface, the base being sanded, stained and finished with polyurethane; a piece of plywood in a rectangular configuration having an upper and lower surface and glued at its lower surface to the upper surface of the base; a piece of artificial turf in a rectangular configuration having an upper surface and a lower surface and glued at its lower surface to the upper surface of the plywood, the piece of turf having a length and width essentially the same as that of the plywood; four apertures formed in the base, plywood and turf in a rectangular configuration, the four dowels located in the apertures to an extent upwardly for holding a football on the dowels; and an oak frame resting on the base, the frame having a rectangular upper section with an external periphery greater than the plywood and turf but less than the base, the frame also including four vertical posts coupled at their upper ends to the rectangular upper section at its corners and resting at its lower ends upon the turf and base.

U.S. Pat. No. 5,558,416

Inventor: Florea Dumitru

Issued: Sep. 24, 1996

A cabinet for displaying objects, consists of a plurality of sides, of which one side is in the form of a door and bears in the closed state on the end surfaces of the two adjoining sides, wherein its outer edges are aligned with the outsides of these sides. The cabinet comprises two hinges arranged one above the other, each consisting of a door hinge part fixed to the door and a housing hinge part, which are rotatably connected together by a pin. Each housing hinge part is fitted on the end of a rod which is movable axially and perpendicular to the closing plane of the door in a bearing body fixed on a lower sheet metal frame located in the lower part of the cabinet or a bearing body fixed on an upper sheet metal frame located in the upper part. In the region of the lower part of the cabinet a gas pressure spring is fitted horizontally in the region of the lower part of the cabinet between the lower sheet metal frame and the door. On opening the door the two rods are firstly pulled out of the bearing bodies by means of a link, so that the outer edge of the door comes free for the following pivotal movement. The gas pressure spring prevents the rod from being pushed back into bearing body on account of the weight of the door when the door is opened.

U.S. Pat. No. 6,158,828

Inventor: Kurt A. Vacovsky

Issued: Dec. 12, 2000

A jersey display frame for displaying the jersey of a uniform in a life-like manner with a three-dimensional view. The display frame includes a frame body and support member fixed to the frame body for supporting the jersey within the display frame. The support member includes a predetermined width, height and depth to provide the visual perception of the jersey in a life-like manner. For example, a football jersey is displayed such that it is visually perceived as it is supported on shoulder pads. The display frame is customized to display all types of jerseys. A hook is threadedly engaged in the support member and is adjustable to allow the jersey to be properly positioned within the display frame.

U.S. Pat. No. 6,322,174

Inventor: Asa Palmqvist

Issued: Nov. 27, 2001

An arrangement for exhibiting an object, for example a flower arrangement. It includes a bottom panel and a panel made of a transparent material between which the object is adapted to be placed and members are adapted to secure the bottom panel relative to the transparent panel. The arrangements has a frame molding which is adapted to surround the bottom panel and the transparent panel. The frame molding has a first cavity extending around and inside the frame molding in which the bottom panel is adapted to be secured. On an inside thereof the frame molding has a second cavity that is disposed a distance from the first cavity in which the transparent panel is disposed after being inserted and rested therein. The arrangement has further a member adapted to permit pushing in and pulling out of the transparent panel into and out from the frame.

U.S. Pat. No. 6,398,322

Inventor: Michael P. B. Chaplin

Issued: Jun. 4, 2002

A showcase comprises a base, a plurality of side walls and a roof. Elongate connecting members, for connecting the side walls to the base, each have a channel defined therein for receiving a lower edge of a respective one of the side walls. Releasable fastenings, preferably in the form of screws, are provided for fastening the connecting members to the base. Further such connecting members may also be provided for connecting the side walls to the roof. The edges of the side walls may be fixed in the respective channels of the connecting members using adhesive.

French Patent Number FR2743928

Inventor: Matthieu Janvier

Issued: Jul. 25, 1997

The instrument case consists of a base to contain the instrument, designed to fold when in the open position to act as a stand for the instrument. The two sections of the base can be locked in the open or closed position by a rack, or by having a braked hinge between them. The lid of the case is divided by a transverse bar to form a compartment which acts as a music stand. The bar being made to fold away when not in use, in a variant of the design the lid can contain a number of supports for bars at different levels, or it can house a folding music stand.

While these display cases may be suitable for the purposes for which they were designed, they would not be as suitable for the purposes of the present invention, as hereinafter described.

SUMMARY OF THE PRESENT INVENTION

The present invention discloses a display case for musical instruments. The display case comprises a housing having spaced apart top surface and bottom surface with side walls, back wall and front wall positioned therebetween. Both the interior and exterior of the cabinet are covered with fabric material, along with the inside of the back panel. The front wall is a removable structure having a border with a transparent member positioned therein for viewing the displayed musical instrument. The interior of the case has a fastener on the back wall for attaching the musical instrument and a light may or may not be located on the base for illuminating the displayed article. A door stop is located on the interior side walls having hook and loop material on the anterior side that mates with hook and loop material located on the interior side of the front panel forming retaining means for the front panel. Also located on the front panel is a handle, a brass knob in the preferred embodiment, for removing the front panel providing access to the display case interior. Additionally, the front corners of the case can have metallic edge protectors and the exterior base can have polymeric or elastomeric pads. The case can also be mounted horizontally by locating the knob in a different location.

A primary object of the present invention is to provide a display case for a guitar or bass guitar.

Another object of the present invention is to provide a display case for a guitar or bass guitar having the appearance of an oversized amplifier.

Yet another object of the present invention is to provide a display case comprised of a housing having spaced apart top and bottom with side walls, back wall and front wall positioned therebetween.

Still yet another object of the present invention is to provide a display case wherein said bottom forming the base can have a light positioned thereon for illuminating the displayed article.

Another object of the present invention is to provide a display case wherein said back wall has a fastener or fasteners positioned thereon for mounting said displayed article.

Yet another object of the present invention is to provide a display case wherein said back wall contains apertures for wall mounted fasteners whereby said display case can be mounted on a wall.

Still yet another object of the present invention is to provide a display case having molding or stop block fastened on the side walls recessed from the front edge and having hook and loop material fastened to the anterior side.

Another object of the present invention is to provide a display case wherein said front wall forms a front panel for viewing said displayed article.

Yet another object of the present invention is to provide a display case wherein said front panel is comprised of a border having a transparent member positioned within said border.

Still yet another object of the present invention is to provide a display case wherein said front panel has a handle, in the preferred embodiment a brass knob, fastened to said border whereby said front panel can be removed from the display case housing.

Still yet another object of the present invention is to provide a display case wherein the interior face of said front panel has mating members of hook and loop material fastened to the periphery edge opposing the side wall stop block hook and loop fasteners.

Another object of the present invention is to provide a display case wherein said front panel border is covered by fabric.

Yet another object of the present invention is to provide a display case wherein piping is attached to the exterior periphery edge of said front panel.

Still yet another object of the present invention is to provide a display case wherein said front panel frictionally engages the housing front panel aperture.

Additional objects of the present invention will appear as the description proceeds.

The present invention overcomes the shortcomings of the prior art by providing a display case for musical instruments, in the preferred embodiment a guitar or bass guitar. The display case is comprised of a housing having spaced apart top surface and bottom surface with side walls, back wall and front wall positioned therebetween. All surfaces are opaque with the exception of the front wall which is a removable structure having a border with a transparent member positioned therein for viewing the displayed musical instrument. The interior of the case has a fastener on the back wall for attaching the musical instrument and can have a light located on the base for illuminating the displayed article. There are also apertures within the back wall for mounting the display case to a wall. A continuous stop block is located on the interior side walls having hook and loop material on the anterior side that mates with hook and loop material located on the interior side of the front panel forming retaining means for the front panel. The front panel is dimensionally designed to frictionally fit within the display case front panel aperture. The frame of the front panel can be covered with fabric and piping positioned on the periphery edge. Also located on the front panel is a handle, a brass knob in the preferred embodiment, for removing the front panel providing access to the display case interior. Additionally, the front corners of the case can have metallic edge protectors and the exterior base can have polymeric or elastomeric pads.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
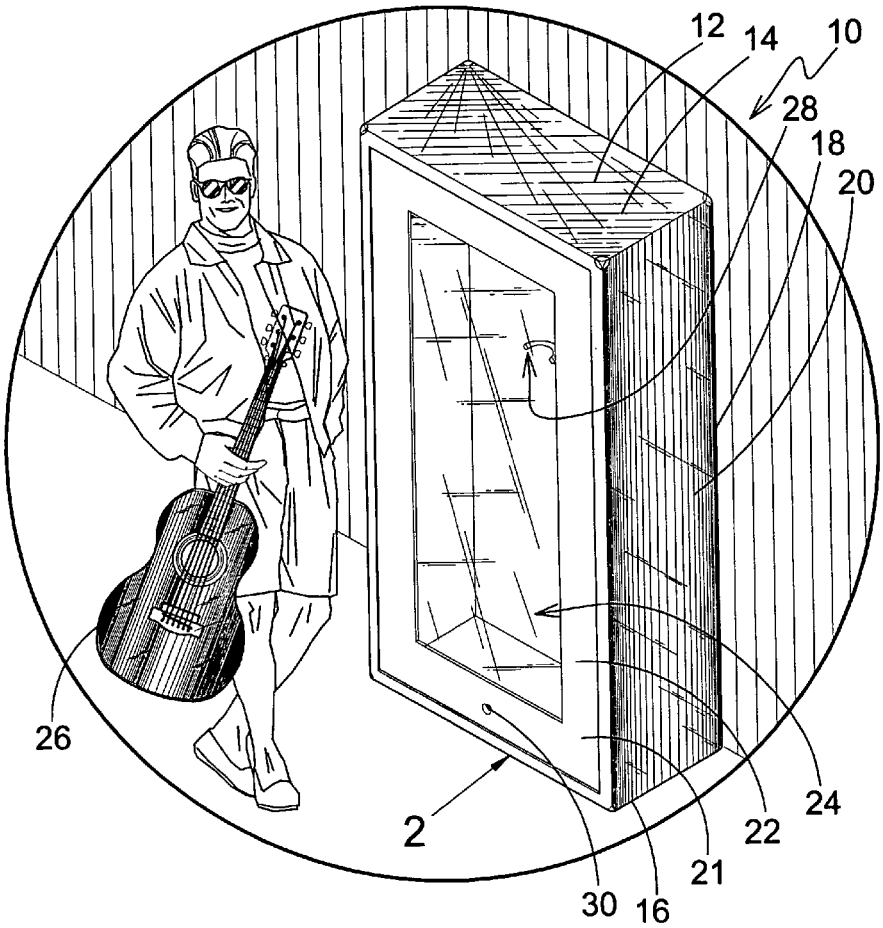
FIG. 1 is an illustrative view of the present invention.

With regards to reference numerals used, the following numbering is used throughout the drawings.

10 present invention
12 housing
14 top
16 bottom
18 back wall
20 side wall
21 front
22 front panel
23 frame
24 transparent member
26 musical instrument
28 hanger
30 knob
32 cap
34 piping design
36 Plexiglas panel
38 door stop
40 hook and loop strips
42 light and fixture
44 clips
46 hanger arms
48 neck

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10. The present invention 10 is a musical instrument 26 display case having the dimensions of an oversized amplifier. The display case 10 is comprised of a housing 12 having a top 14, bottom 16, back wall 18, side walls 20 and a front 21 with a removable recessed front panel 22 that is substantially transparent at 24. The interior compartment of the display case 10 has a fastener 28 on the interior rear wall 18 for mounting the musical instrument 26, such as a guitar. Located on the interior base 16 a light can be positioned to highlight the musical instrument. Also located in the interior is molding recessed from the front edge 21 of the display case 10 having hook and loop material that mates with hook and loop material fastened to the periphery edge of the front panel. The front panel 22 is comprised of a frame having a transparent member 24 mounted therein. Both the interior and exterior of the cabinet are covered with fabric material, along with the inside of the back panel 18. The frame is also covered by fabric with piping fastened to the exterior periphery edge. The front panel 22 conforms substantially in size to the opening created by the walls of the enclosure 12 and frictionally fits therein. A knob 30 located at the base of the front panel 22 provides means for accessing the interior of the display case 10.

Figure 2:
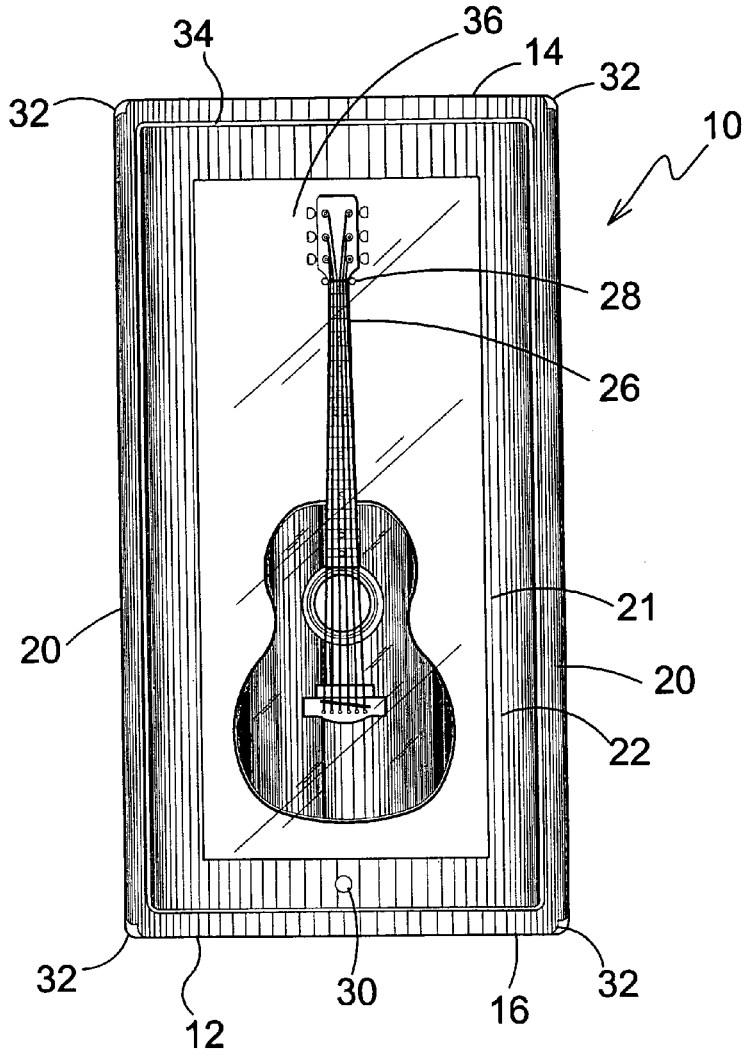
FIG. 2 is a front view of the present invention.

Turning to FIG. 2, shown therein is a front view of the present invention 10. Shown is the present invention 10 providing a guitar cabinet having a housing 12 comprising a top 14, bottom 16, two side walls 20 and a front 21, each corner of the cabinet having protective caps 32. The front 21 of the cabinet 12 provides a framed opening with a door stop encompassing the inner portion of the opening. A piping design 34 decorates the framed portion of the front of the cabinet. A front panel 22 or door is provided and is friction fitted to the cabinet's front opening. Velcro strips provide a secure closure. The door frame 22 comprises a Plexiglas panel 36 held to the door frame by means of clips located on the inner portion of the frame. A hanger device 28 is provided on the interior portion of the rear wall and serves to hang the instrument 26 placed within the cabinet. A light fixture of low voltage can be located at the bottom of the cabinet 12 positioned to illuminate the displayed guitar 26. A brass knob 30 is also shown.

Figure 3:
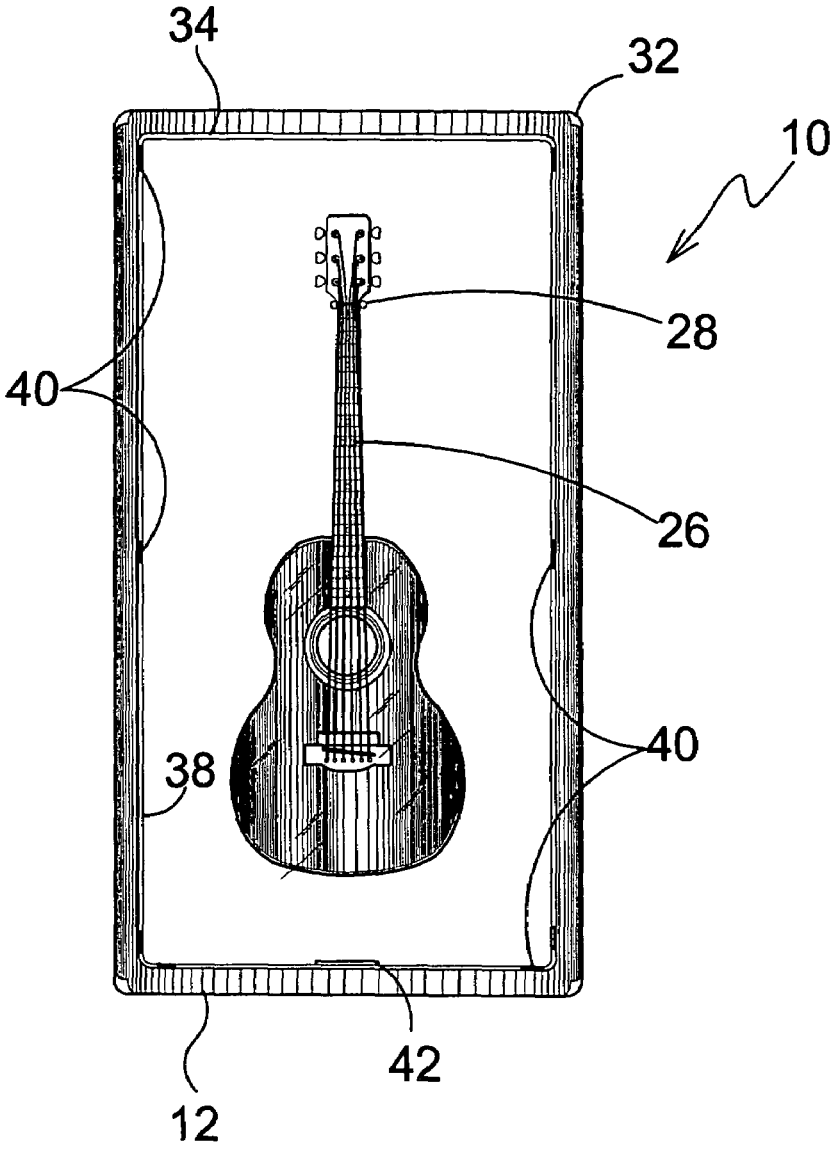
FIG. 3 is a front view of the present invention with front door panel removed.

Turning to FIG. 3, shown therein is a front view of the present invention 10 with front door panel removed. Shown is the present invention 10 providing a guitar cabinet having a housing 12 comprising a top, bottom, two side walls and a front with each corner of the cabinet having protective caps 32. The front of the cabinet 12 provides a framed opening with a door stop 38 encompassing the inner portion of the opening. A piping design 34 decorates the framed portion of the front of the cabinet 12. A door is provided and is friction-fitted to the cabinet's front opening. Hook and loop strips 40 spaced apart around the door stop 38 provide a secure closure. The door frame comprises a Plexiglas panel held to the door frame by means of clips (not shown but see FIG. 7) located on the inner portion of the frame. A hanger device 28 is provided on the interior portion of the rear wall and serves to hang the instrument 26 placed within the cabinet. A light fixture 42 of low voltage can be located at the bottom of the cabinet 12 and positioned to illuminate the displayed guitar 26.

Figure 4:
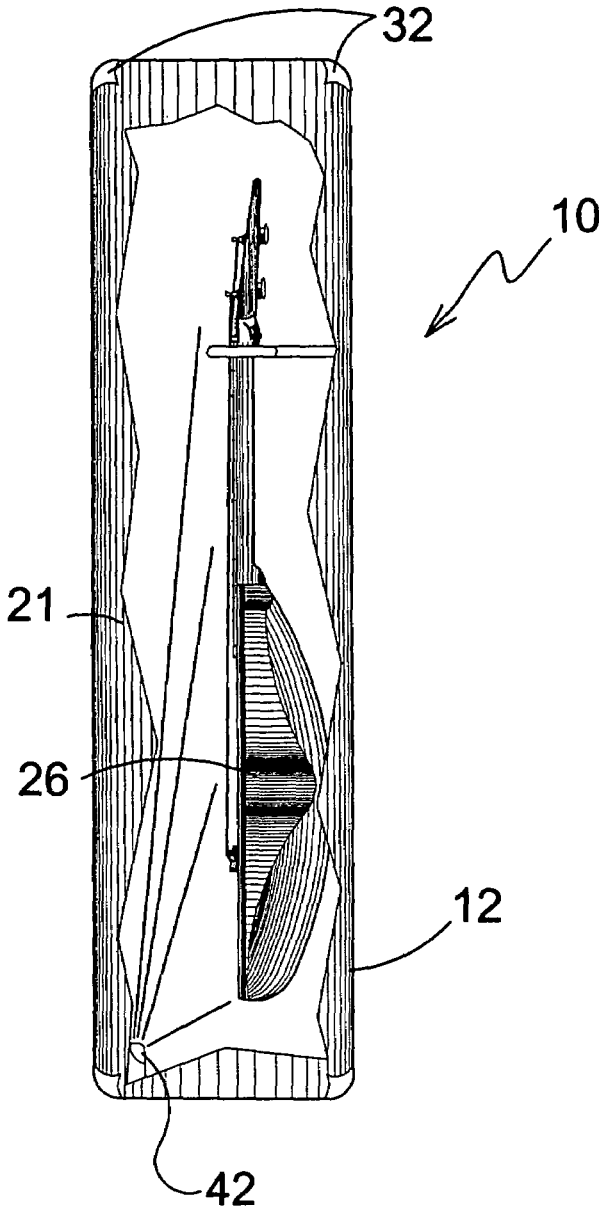
FIG. 4 is a cutaway side view of the present invention.

Turning to FIG. 4, shown therein is a cutaway side view of the present invention 10. Shown is the present invention 10 providing a guitar cabinet having a housing 12 comprising a top, bottom, two side walls and a front, with each corner of the cabinet having protective caps 32. The front 21 of the cabinet 12 provides a framed opening with a door stop encompassing the inner portion of the opening. A piping design decorates the framed portion of the front 21 of the cabinet. A door is provided and is friction fitted to the cabinet's front opening. Hook and loop strips provide a secure closure. The door frame has a Plexiglas panel held to the door frame by means of clips located on the inner portion of the frame. A hanger device 28 is provided on the interior portion of the rear wall and serves to hang the instrument 26 placed within the cabinet. A light fixture 42 of low voltage can be located at the bottom of the cabinet to illuminate the displayed article.

Figure 5:
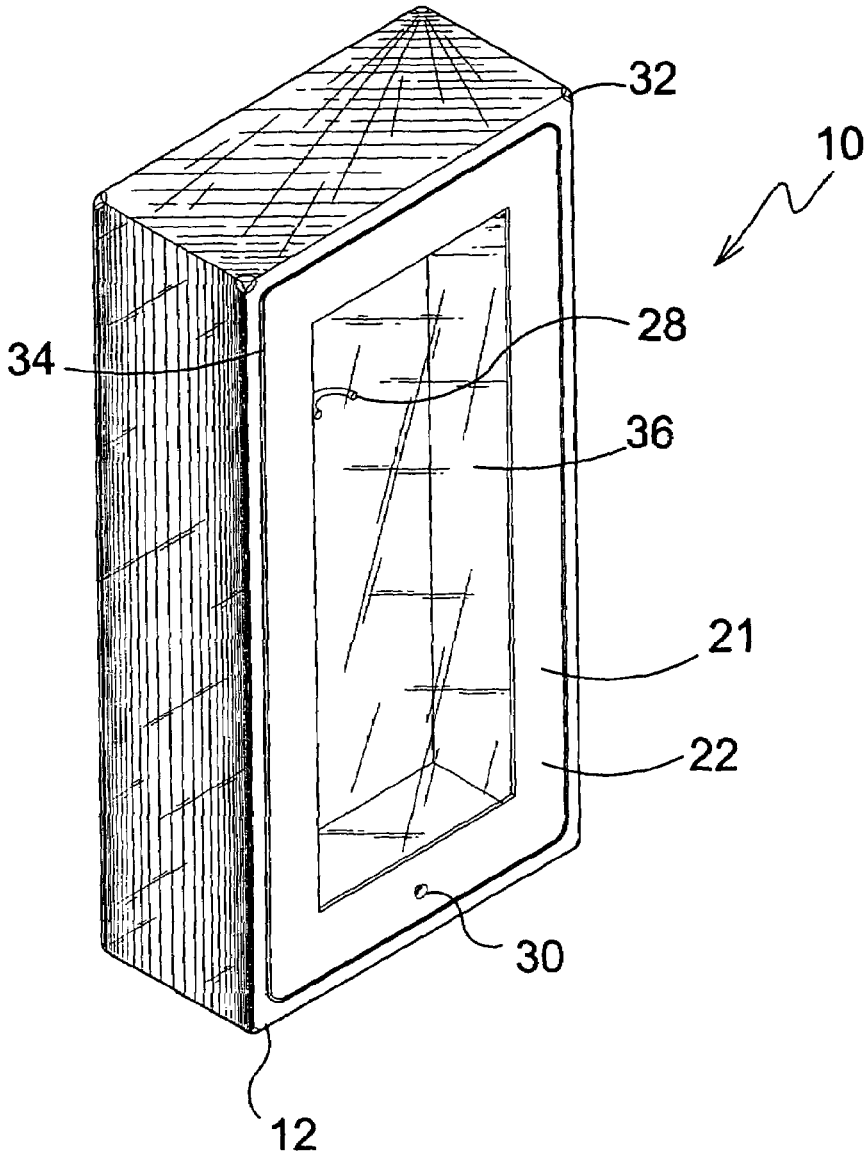
FIG. 5 is a perspective view of the present invention.

Turning to FIG. 5, shown therein is a perspective view of the present invention 10. Shown is the display case 12 of the present invention 10 comprising a top surface and bottom surface with side walls, back wall and front wall positioned therebetween. The front wall 21 is comprised of a removable front panel 22 that is designed for viewing of the displayed article. The front panel 22 has a border that may be covered in material and a transparent member 36 positioned therein with piping 34 fixed to the periphery edge of the border. The front panel 22 is dimensioned to frictionally fit within the display case front aperture or door stop. A brass knob 30 is fastened to the front panel 22 frame providing means for removing the front panel to gain access to the display case interior. Fastened to the back side periphery edge of the front panel 22 are lengths of hook and loop material that are positioned to mate with opposing lengths of hook and loop material fastened to the anterior side of stop blocks or door stop fastened to the interior sides of the display case. Positioned on the interior base can be a light for illuminating the article being displayed. Also shown are the hanger 28 and protective corner caps 32.

Figure 6:
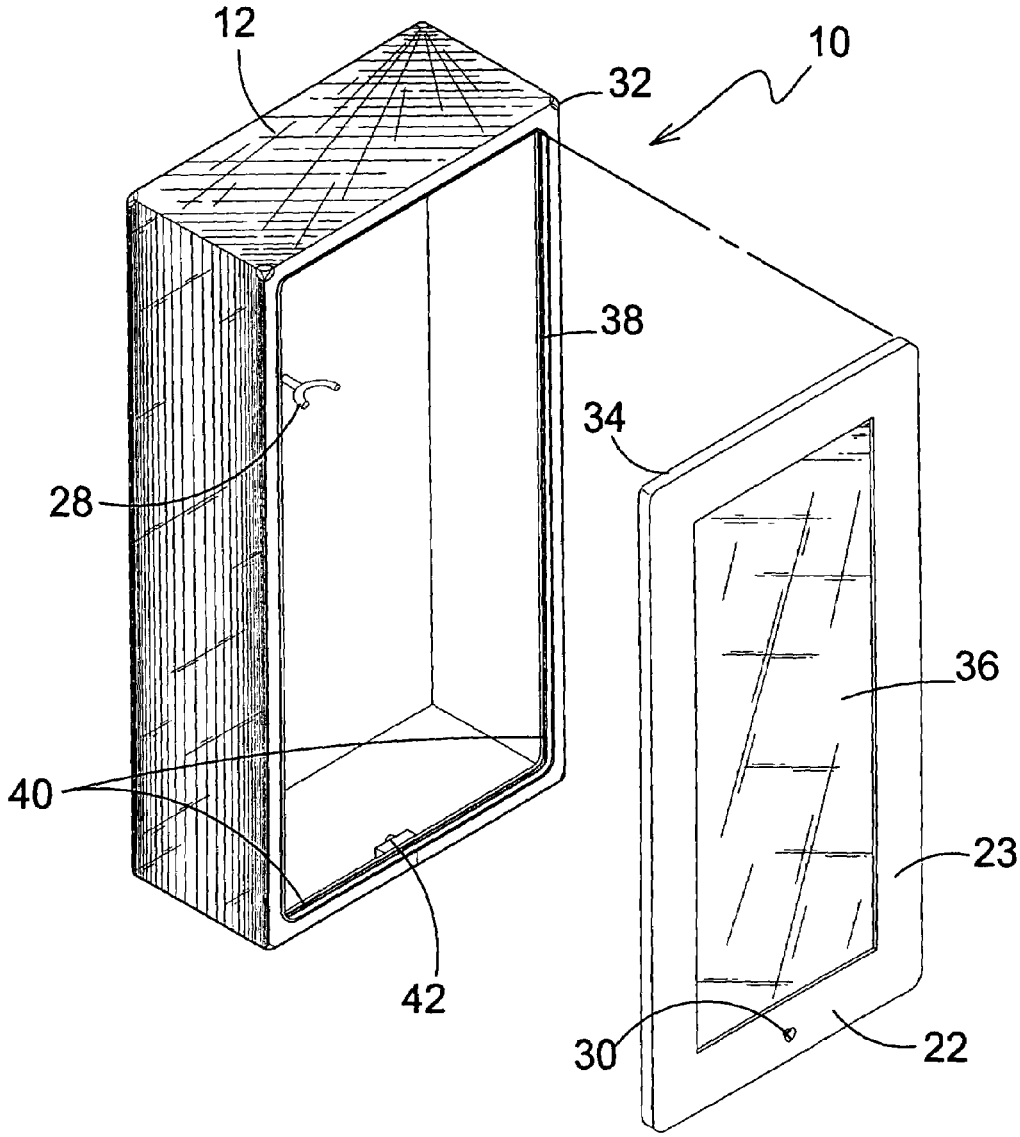
FIG. 6 is an exploded view of the present invention.

Turning to FIG. 6, shown therein is an exploded view of the present invention 10. Shown is the display case of the present invention 10 with the front panel 22 removed. The front panel 22 is designed for viewing the displayed article. The front panel 22 has a border or frame 23 that may be covered in material and a transparent member 36 positioned therein with piping 34 fixed to the periphery edge of the border. The front panel 22 is dimensioned to frictionally fit within the display case 12 front aperture or door stop 38. A brass knob 30 is fastened to the front panel 22 frame providing means for removing the front panel to gain access to the display case interior. The back side of the periphery edge of the front panel 22 has lengths of hook and loop material that are positioned to mate with opposing lengths of hook and loop material 40 fastened to the anterior side of stop blocks or door stop 38 fastened to the interior sides of the display case 12. Positioned on the interior base is a light 42 for illuminating the article being displayed. Fixedly positioned to the back wall is mounting means 28 for the displayed article comprised of spaced apart arms for receiving and supporting the displayed article. Also shown are the protective corner caps 32.

Figure 7:
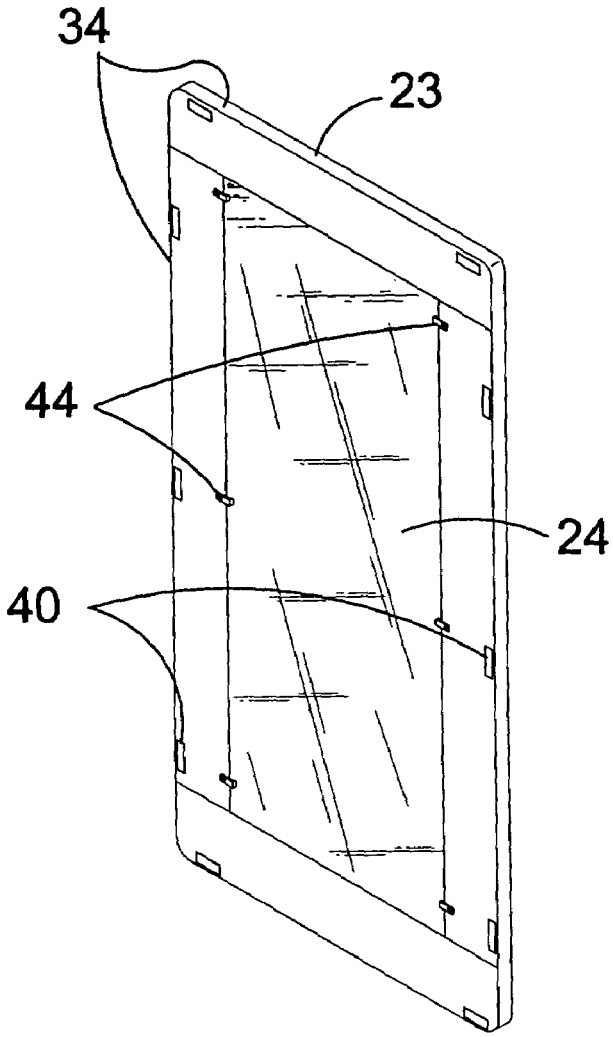
FIG. 7 is a back view of the removable front panel of the present invention.

Turning to FIG. 7, shown therein is a back view of the removable front panel 22 of the present invention. The back side of the front panel 22 shows a transparent member 24 mounted within the frame. The frame 23 can be covered by fabric with piping 34 fastened to the exterior periphery edge. The front panel 23 conforms substantially in size to the opening created by the display case walls and frictionally fits therein. Fastened to the back side periphery edge of the front frame 23 are lengths of hook and loop material 40 that are positioned to mate with opposing lengths of hook and loop material fastened to the anterior side of stop blocks or door stop fastened to the interior sides of the display case. Also shown are clips 44.

Figure 8:
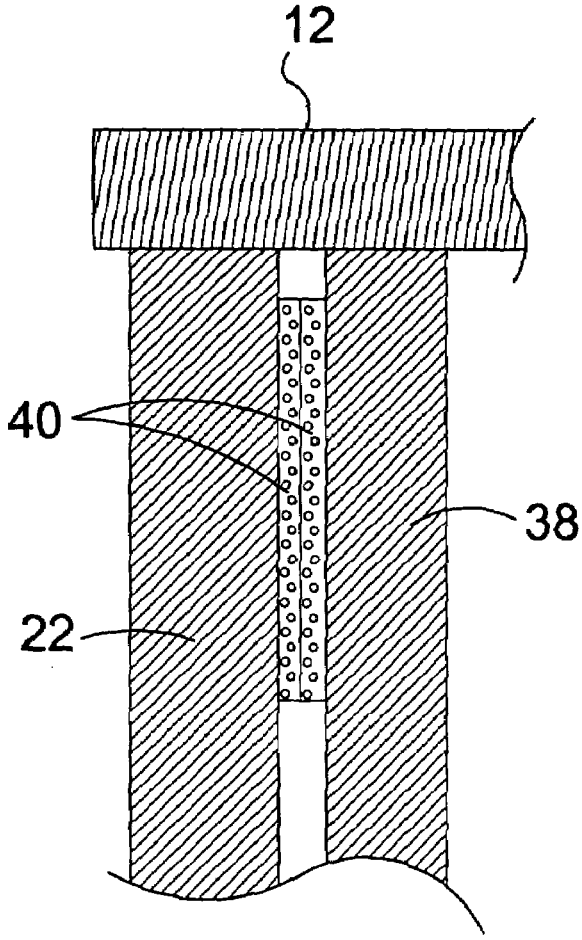
FIG. 8 is a sectional view of the front panel fastened to the display case

Turning to FIG. 8, shown therein is a sectional view of the front panel 22 fastened to the display case 12. Shown is the front panel 22 of the cabinet 12 providing a framed opening with a door stop 38 encompassing the inner portion of the opening. A removable front panel 22 is provided and is designed to frictionally fit within the front wall display case aperture or door stop 38. Mating hook and loop material strips 40 fastened to the anterior side of the door stop 38 and posterior side of the front panel 22 provides a secure closure of the front panel to the display case.

Figure 9:
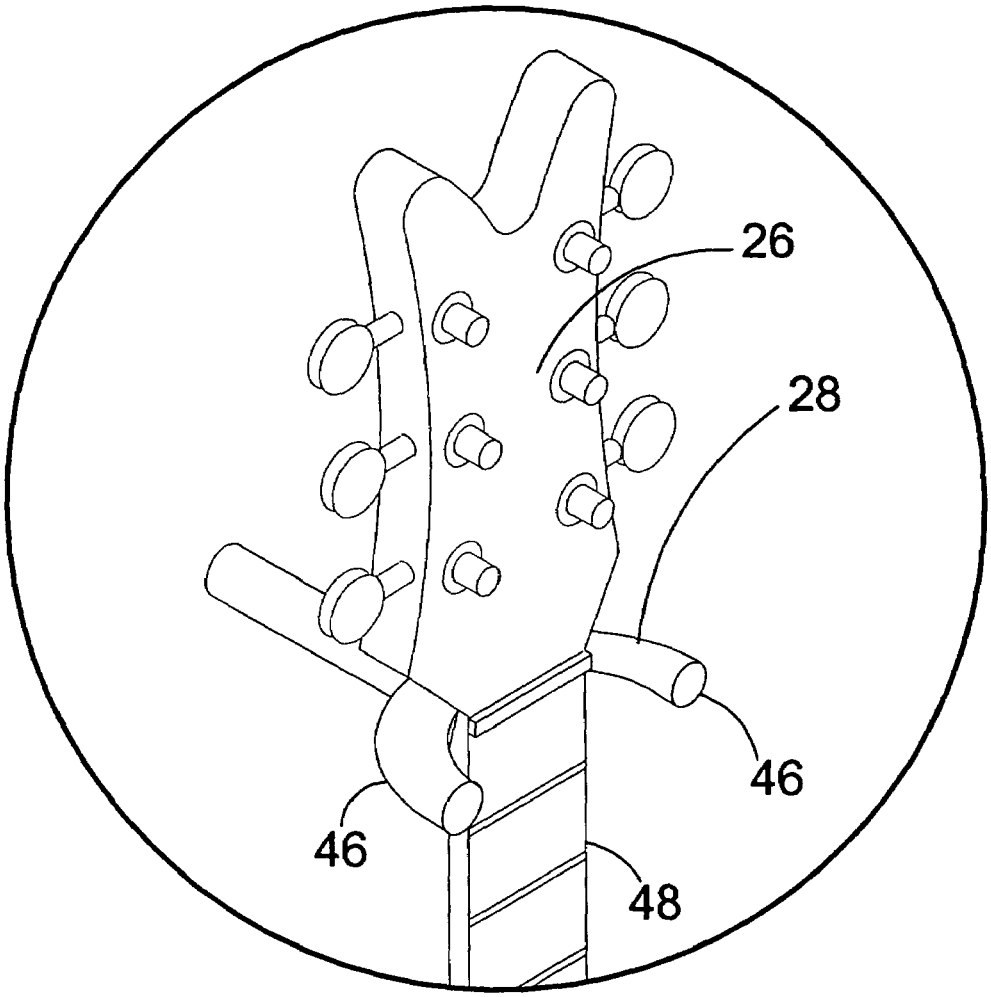
FIG. 9 is a perspective view of the hanger.

Turning to FIG. 9, shown therein is a perspective view of the hanger 28. Shown is the hanger 28 of the present invention comprising a device fastened to the interior side of the back wall having spaced apart arms 46 projecting therefrom whereby the neck 48 of the musical instrument 26 can be positioned therein and supported thereby.

I claim:

1. A display case for and in combination with a guitar, comprising:

a) a housing having a top, a bottom, a back, a pair of sides and a front, wherein said housing has an inside and an outside;

b) a rectangular door frame opening formed in said front of said housing, a door frame fitted into said opening, said door frame having a transparent member therein, wherein said door frame has a front surface, a rear surface, and outer side edges extending around a perimeter of said door frame;

c) a door stop disposed on inner edges of said opening to receive said door frame, said door frame being without hinges and sized to frictionally fit within said opening;

d) a knob disposed on a bottom portion of a front surface of said door frame to permit the door frame to be removed from the housing;

e) a U-shaped hanger on said back within said housing for receiving a neck of said guitar to support and permit said guitar to be displayed;

f) a light disposed inside said housing below said opening and behind said front to illuminate the guitar;

g) hook and loop material disposed on said door stop and mating hook and loop material on a rear of said outer side edges of said door frame to permit the door frame to be removably mounted on the door stop;

h) a plurality of clips disposed on a rear surface of said door frame about an opening in said door frame for attaching said transparent member to said door frame; and i) decorative piping mounted on said outer edges of said door frame.

2. The display case or claim 1, wherein said transparent member is a plastic material.

3. The display case of claim 2, wherein said knob is made of brass.

4. The display case of claim 3, further comprising a plurality of caps being disposed on corners of said housing to permit the corners to be protected.

* * * * *